US008251640B2

(12) United States Patent
Beckford et al.

(10) Patent No.: US 8,251,640 B2
(45) Date of Patent: Aug. 28, 2012

(54) BLADE ASSEMBLY

(75) Inventors: Peter Rowland Beckford, Derby (GB); Daniel John Allan Swan, Derby (GB); Caroline Halliday, Derby (GB)

(73) Assignee: Rolls-Royce PLC (GB)

( * ) Notice: Subject to any disclaimer, the term of this patent is extended or adjusted under 35 U.S.C. 154(b) by 1129 days.

(21) Appl. No.: 12/053,915

(22) Filed: Mar. 24, 2008

(65) Prior Publication Data

US 2008/0260536 A1 Oct. 23, 2008

(30) Foreign Application Priority Data

Apr. 18, 2007 (GB) ..... 0707426.3

(51) Int. Cl.

| | |
|---|---|
| ***F01B 25/16*** | (2006.01) |
| ***F01D 21/00*** | (2006.01) |
| ***F01D 5/00*** | (2006.01) |
| ***B63H 1/00*** | (2006.01) |

(52) U.S. Cl. ..... 415/9; 416/2

(58) Field of Classification Search ..... 416/2, 146 R, 416/241 R, 248; 415/9, 173.4, 174.4
See application file for complete search history.

(56) References Cited

U.S. PATENT DOCUMENTS

| | | | | |
|---|---|---|---|---|
| 2,362,804 | A * | 11/1944 | Cox, Jr. | 416/2 |
| 3,744,927 | A * | 7/1973 | Bernaerts | 416/2 |
| 4,111,600 | A | 9/1978 | Rothman et al. | |
| 4,492,521 | A | 1/1985 | Pask et al. | |
| 4,730,984 | A | 3/1988 | Ortolano | |
| 5,018,271 | A | 5/1991 | Bailey et al. | |
| 5,176,499 | A | 1/1993 | Damlis et al. | |
| 5,340,280 | A | 8/1994 | Schilling | |
| 5,405,102 | A * | 4/1995 | Greene | 244/1 R |
| 5,443,367 | A | 8/1995 | Samit et al. | |
| 5,490,764 | A | 2/1996 | Schilling | |
| 5,749,706 | A | 5/1998 | Maar | |
| 6,467,168 | B2 | 10/2002 | Wallis | |
| 6,536,208 | B1 * | 3/2003 | Kretschmer | 60/258 |
| 6,609,884 | B2 | 8/2003 | Harvey | |
| 7,112,044 | B2 * | 9/2006 | Whitehead et al. | 416/229 R |
| 7,118,346 | B2 * | 10/2006 | Read | 416/232 |
| 7,311,500 | B2 | 12/2007 | Rongong et al. | |
| 7,758,311 | B2 | 7/2010 | Loehle et al. | |
| 8,016,561 | B2 | 9/2011 | Moniz et al. | |
| 2005/0158171 | A1 | 7/2005 | Carper et al. | |
| 2008/0019838 | A1 | 1/2008 | Read et al. | |
| 2010/0054938 | A1 | 3/2010 | Beckford et al. | |

FOREIGN PATENT DOCUMENTS

| | | | |
|---|---|---|---|
| FR | 2712631 | A | 5/1995 |
| GB | 1332679 | | 11/1970 |
| GB | 2323637 | A | 9/1998 |
| GB | 2399866 | A1 | 9/2004 |
| JP | 9089709 | A | 4/1997 |
| WO | 96/34181 | | 10/1996 |
| WO | 2007048996 | A1 | 5/2007 |

* cited by examiner

*Primary Examiner* — Dwayne J White
*Assistant Examiner* — Su Htay
(74) *Attorney, Agent, or Firm* — McCormick, Paulding & Huber LLP

(57) ABSTRACT

A blade assembly for a rotary component comprises an aerofoil member and a displacement apparatus on the aerofoil member for displacing a detached first portion of the aerofoil member in a rearward direction relative to a second portion of the aerofoil member. On failure of the aerofoil member, the displacement apparatus displaces the first portion from the second portion in the rearward direction.

10 Claims, 5 Drawing Sheets

30
22
43
42
32

36
G
30
22
B
43
44
32
38

36
G
30
22
B
43
36
44
32
38

BLADE ASSEMBLY

CROSS REFERENCE TO RELATED APPLICATION

This application is entitled to the benefit of British Patent Application No. GB 0707426.3 filed on Apr. 18, 2007.

FIELD OF THE INVENTION

This invention relates to blade assemblies. More particularly, but not exclusively, the invention relates to blade assemblies for rotary components of a gas turbine engine. Embodiments of the invention relates to blade assemblies for a fan of a gas turbine engine.

BACKGROUND OF THE INVENTION

The fan of a gas turbine engine comprises a plurality of fan blades mounted on a hub. In the event of impact damage, each fan blade must be sufficiently robust to survive as a trailing blade in the event that portions of the immediately preceding blade are detached. The fan blades are reinforced to increase the stiffness, strength and mass of the blade.

SUMMARY OF THE INVENTION

According to one aspect of this invention, there is provided a blade assembly for a rotary component of an engine, the blade assembly having an aerofoil member, a mounting support to support the aerofoil member and mount the blade on a hub, and a displacement apparatus on the aerofoil member for displacing a detached first portion of the aerofoil member in a rearward direction relative to a second portion of the aerofoil member, the second portion remaining attached to the mounting support, whereby on failure of the aerofoil member, the displacement apparatus displaces the first portion from the second portion in the rearward direction.

The rotary component may comprise a fan, and the blade assembly may comprise a fan blade assembly.

In one embodiment, the displacement apparatus may comprise at least one passage extending across the aerofoil member. The displacement apparatus may comprise a plurality of passages extending across the aerofoil member.

The, or each, passage may hold a force applying medium to apply a force when released from the passage. The force applying medium may comprise a compressed fluid, such as a gas, whereby when the aerofoil member fails across the passage, the compressed fluid is released to apply the force on the first portion to displace the first portion rearwardly.

Alternatively, the passages may be arranged in pairs. The passages of each pair may extend generally parallel to one another. A first fluid may be held in one passage of the, or each, pair. A second fluid may be held in the other of the, or each, pair.

The first and second fluids may be reactable explosively with one another to provide the aforesaid force to the first portion. The first and second fluids may be hypergolic. The first fluid may comprise an oxidiser. The second fluid may comprise a fuel.

Thus, in this embodiment, when the aerofoil member fails across the, or one, pair of passages, the first and second fluids are released from the passages to react explosively to apply the force to the first portion to displace it rearwardly.

Suitable such first and second fluids may be as follows: liquid hydrogen and liquid oxygen; liquid fluorine and liquid hydrogen; liquid fluorine and hydrazine; FLOX-70 and berosene; nitrogen tetroxide and hydrazine; nitrogen tetroxide and monomethyl hydrazine; nitrogen tetroxide and unsymmetrical dimethyl hydrazine; nitrogen tetroxide and aerozine 50; red-fuming nitric acid and hydrazine; red-fuming nitric acid and monomethyl hydrazine; red-fuming nitric acid and unsymmetrical dimethtyl hydrazine; red-fuming nitric acid and aerozine 50; hydrogen peroxide and hydrazine.

The, or each, passage may be angled across the aerofoil member such that the, or each, passage extends transverse to a direction of a line of failure across the aerofoil member, whereby the line of failure cuts through at least one passage, or one of pair of passages. The, or each passage may extend diagonally across the aerofoil member.

In another embodiment, the displacement apparatus may comprise a region of weakness on the leading edge of the aerofoil member, whereby failure of the aerofoil member occurs at said region of weakness. The region of weakness may be provided in an area of the aerofoil member such that the center of gravity of the aerofoil member causes the aforesaid rearward displacement of the first portion on failure of the aerofoil member at said region of weakness. The region of weakness may comprise a fuse on said leading edge of the aerofoil member. If desired, the embodiment which includes the region of weakness may also include the aforesaid passage or passages as described above.

DETAILED DESCRIPTION OF THE PREFERRED EMBODIMENTS

Figure 1:
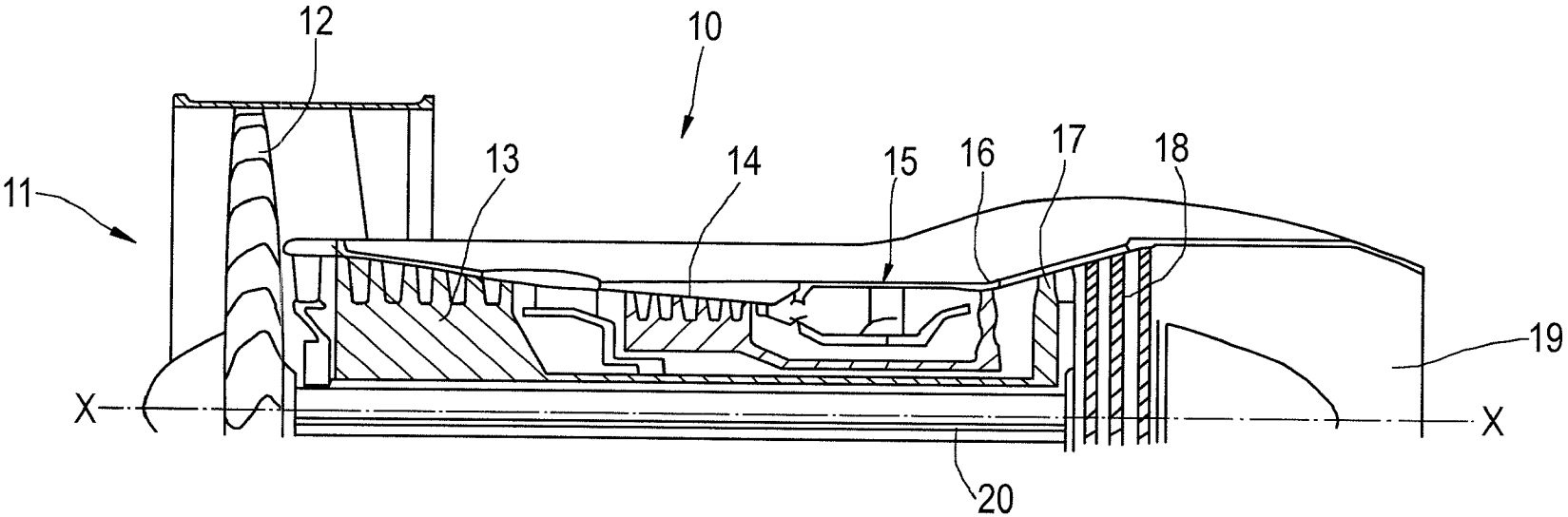
FIG. 1 is a sectional side view of the upper half of a gas turbine engine.

Referring to FIG. 1, a gas turbine engine is generally indicated at 10 and, includes, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts 20.

Figure 2:
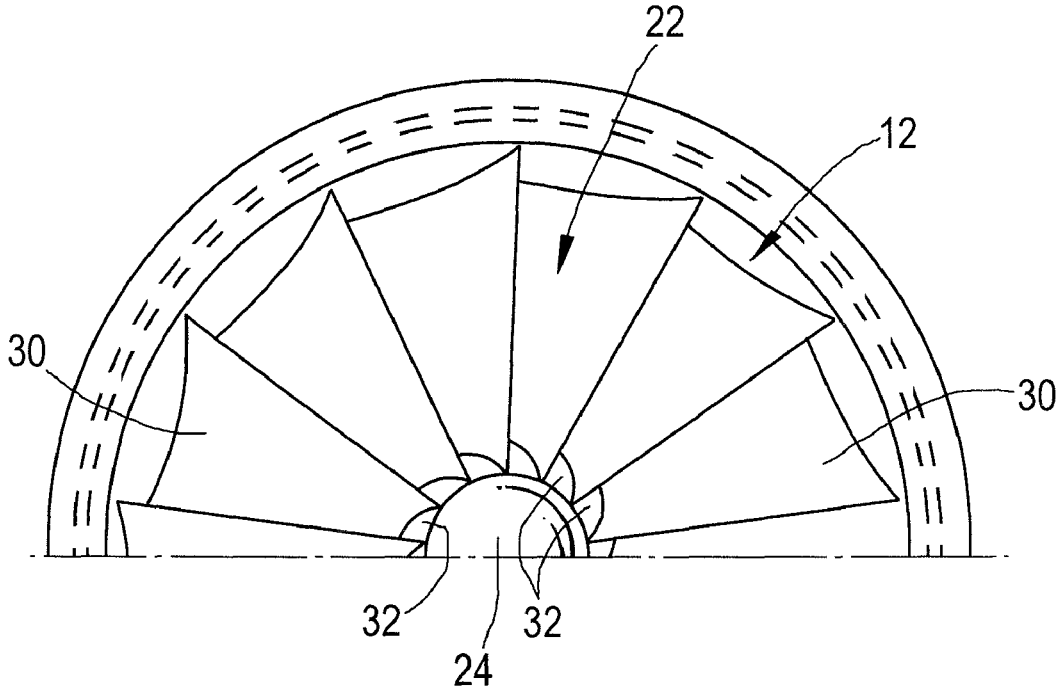
FIG. 2 is a front view of the upper half of the fan of the gas turbine engine shown in FIG. 1.

Referring to FIG. 2, the fan 12 comprises a plurality of blade assemblies in the form of fan blade assemblies 22 mounted on a rotatable disc 24. Each fan blade assembly comprises an aerofoil member 30 and a mounting support in the form of a platform 32. If, during operation of the engine 10, the fan is struck by an incoming object, then one of the blade assemblies 22 can fail. The failure can take the form of a portion of the blade assembly 22 becoming detached. A problem that can arise is that the detached portion can then be struck by the next blade assembly 22 during rotation thereof.

Figure 3:
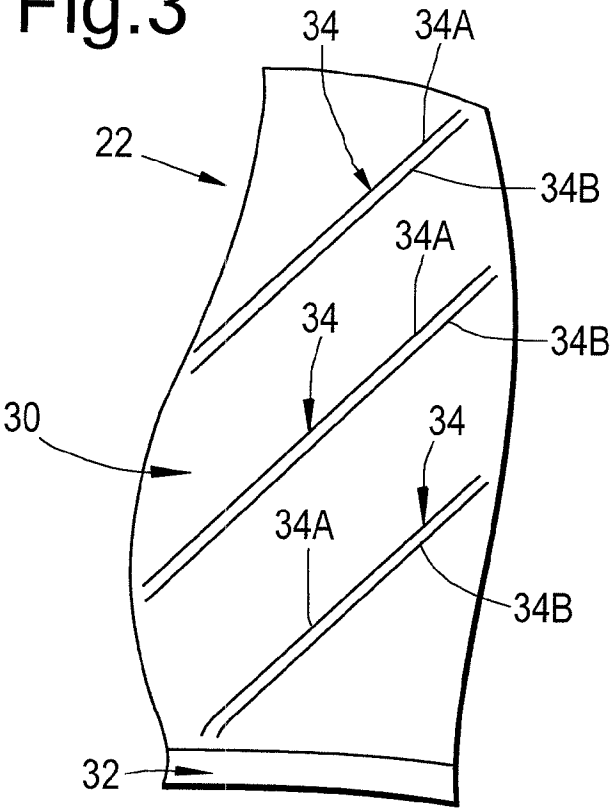
FIG. 3 shows a blade assembly with one embodiment of a displacement means.

Referring to FIG. 3, there is shown a fan blade assembly 22 which comprises the aerofoil member 30 and the platform 32 for securing the blade assembly 22 to the hub 24 and upon which the aerofoil member 30 is mounted.

In the embodiment shown in FIG. 3, the aerofoil member 30 defines a plurality of diagonally extending passages 34 which extend across the aerofoil member 30 in pairs. In each of pair of the passages 34, one passage, for example labelled 34A is filled with a first fluid material and the other passage of the pair, for example labelled 34B in FIG. 3 is filled with a second fluid material. The first and second fluid materials are selected such that they react explosively when mixed.

Figure 4:
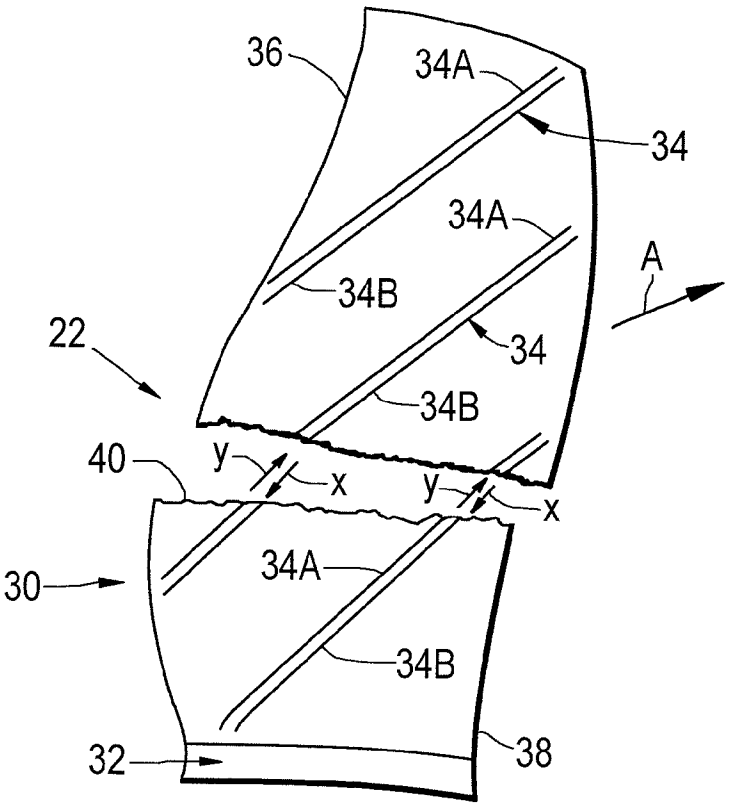
FIG. 4 shows the fan blade in FIG. 3 after failure thereof.

FIG. 4 shows the blade assembly 22 of FIG. 3 after failure of the aerofoil member 30 in which a radially outer first portion 36 is detached from a radially inner second portion 38. The second portion 38 is attached to the platform 32. A line of failure 40 is shown extending across the aerofoil member 30. The line of failure 40 extends through two pairs of the passages 34 which releases the first and second fluids from the passages 34A, 34B respectively, as shown by the arrows X and Y.

The first and second fluids mix and spontaneously explodes, thereby imparting a force indicated by the arrow A on the first portion 36 to displace the first portion 36 in the direction of arrow A.

The force on the first portion 36 is such that the first portion 36 is displaced rapidly in a rearward direction away from the trailing blade and therefore the trailing blade does not strike the detached portion 36 and is not damaged.

Figure 6:
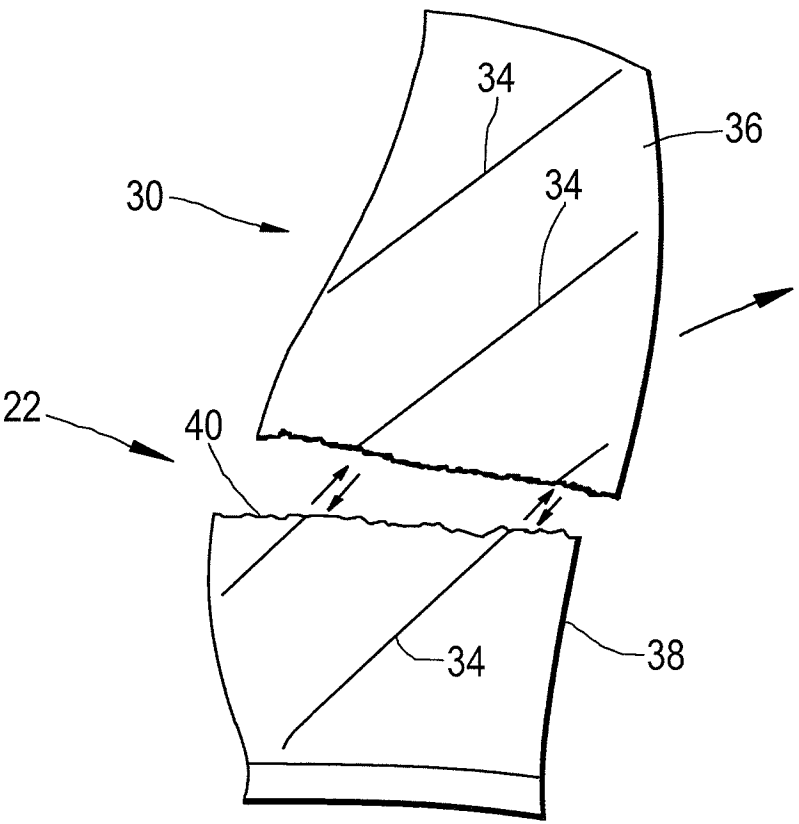
FIG. 6 shows the fan blade of FIG. 5 after failure thereof.
Figure 5:
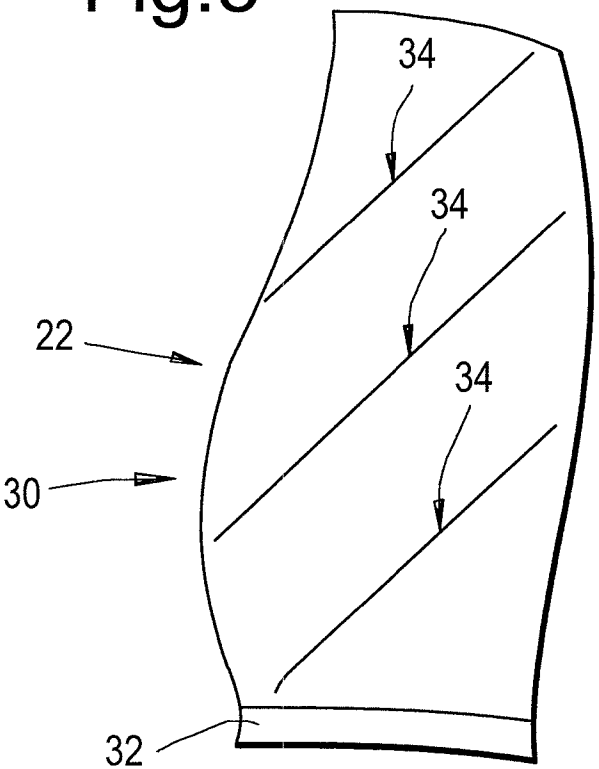
FIG. 5 shows a further blade assembly with another embodiment of a displacement means.

Referring to FIGS. 5 and 6, showing embodiments which are generally the same as the embodiments shown in FIGS. 3 and 4 with the exception that the passages 34 are not arranged in pairs, and instead extend singly in a diagonal direction across the aerofoil member 30. In each of the passages 34 shown in FIGS. 5 and 6, there is provided a compressed fluid, such as a compressed gas.

On failure of the aerofoil member 30, as shown in FIG. 6, the line of failure 40 cuts across the passages 34. The compressed gas in the passages 34 is as shown by the arrows X and Y. The release of the compressed gas imparts a force shown by the arrow A to displace the radially outer first portion 36 in the direction of the arrow A away from the trailing blades on the fan 12.

Figures 7, 8, 9:
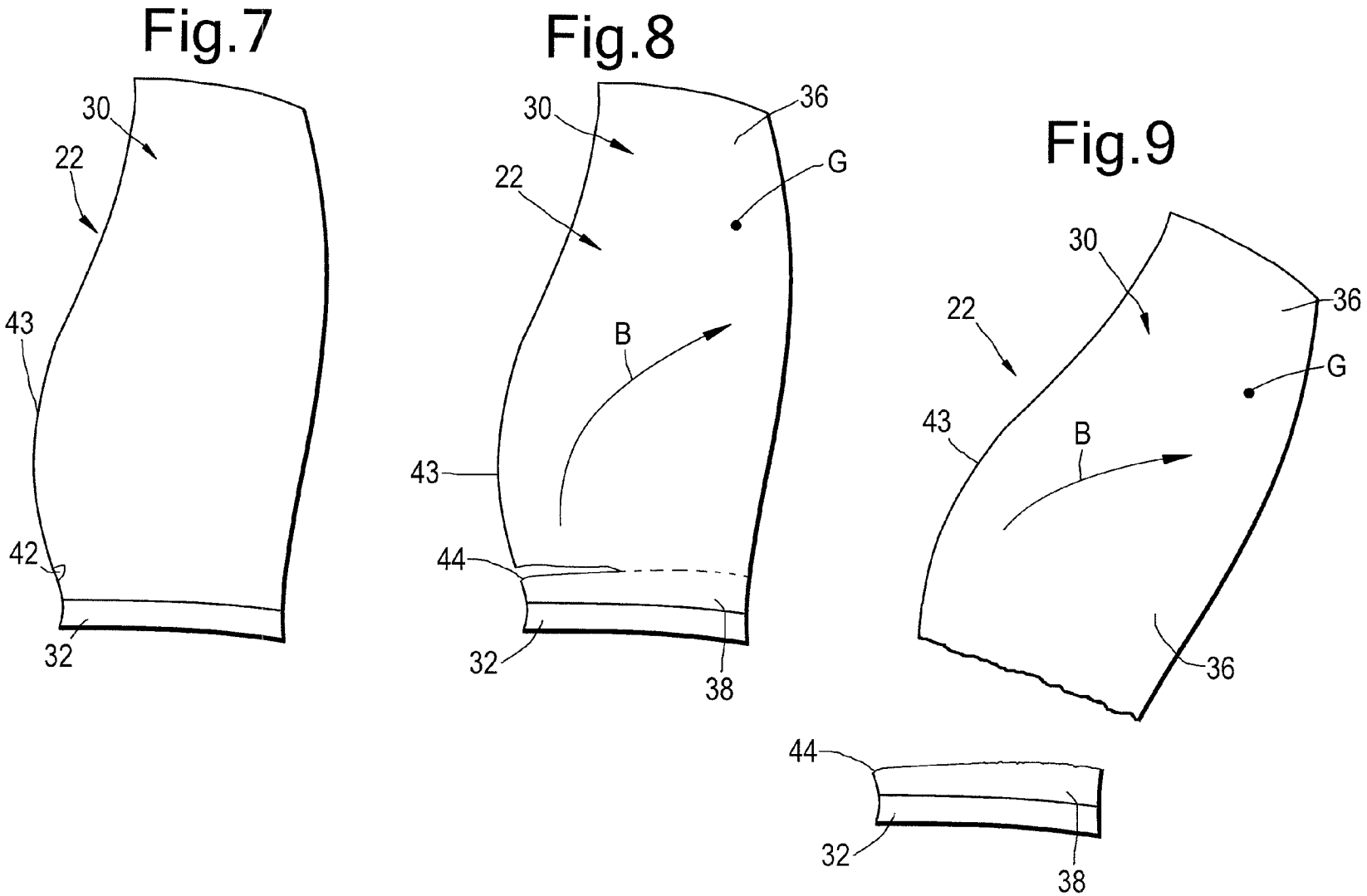
FIG. 7 shows a blade assembly with a further embodiment of a displacement means.
FIG. 8 shows the fan blade of FIG. 7 after partial failure thereof.
FIG. 9 shows the fan blade of FIG. 7 after total failure thereof.

FIGS. 7 to 9 show a further embodiment, in which the mounting support 32 of the fan blade assembly 22 is provided with a region of weakness 42 adjacent the platform 32. The region of weakness is in the form of a fuse. The region of weakness 42 is provided on the leading edge 43 of the aerofoil member 30, at the radially end region of the aerofoil member 30, adjacent the platform 32. When the aerofoil member 22 is struck by an object, the aerofoil member 30 fails at the region of weakness 42. As shown in FIG. 8, a line of failure 44 extends part way across the aerofoil member 30 of the blade assembly 22.

The center of gravity G of the aerofoil member 22 is such that the radially outer first portion 36 rolls rearwardly as shown by the arrow B thereby increasing the length of the line of failure 44. This rearward rolling of the first portion 36 continues until the first portion 36 becomes completely detached from the second portion 38 and is displaced from a rearward direction from the fan 12 away from the other blades 22, as shown in FIG. 9. Thus, in this embodiment, the center of gravity is such that it has a tendency to pull the failing first portion 36 of the main body 22 in a rearward direction, thereby tearing the aerofoil member 30 apart along the line of failure 44.

There is thus described a simple and effective way in which a failed blade of a fan of a gas turbine engine can be prevented from damaging other blades of the fan.

Various modifications can be made without departing from the scope of the invention. For example, the angles of the passages 34 can be varied dependent upon the likely line 40 of failure across the blades. The angle of the passages can be selected such that the line of failure will cross at least one passage, or one pair of passages 34.

What is claimed is:

1. A blade assembly for a rotary component of an engine, the blade assembly comprising an aerofoil member, a mounting support to support the aerofoil member, and a displacement means on the aerofoil member for displacing a detached first portion of the aerofoil member in a rearward direction relative to a second portion of the aerofoil member, the displacement means comprising at least one passage extending across the aerofoil member and the or each passage holding a force applying medium to apply a force when released from the or each passage on failure of the aerofoil member, whereby the displacement means displaces the first portion from the second portion in the rearward direction.

2. A blade assembly according to claim 1 wherein the force applying medium comprises a compressed fluid, whereby when the aerofoil member fails across at least one of the passages, the compressed fluid is released to apply the force on the first portion to displace the first portion rearwardly.

3. A blade assembly according to claim 1 wherein the passages are arranged in pairs and the passages of each pair extend generally parallel to one another, a first fluid being held in one passage of the, or each, pair, and second fluid is held in the other of the, or each, pair, the first and second fluids being reactable with one another to provide the aforesaid force to the first portion.

4. A blade assembly according to claim 3 wherein the first and second fluids are selected from the following hypergolic pairs of fluids: liquid hydrogen and liquid oxygen; liquid fluorine and hydrazine; FLOX-70 and kerosene; nitrogen tetroxide and hydraze; nitrogen tetroxide and monomethyl hydrazine; nitrogen tetroxide and unsymmetrical dimethyl hydrazine; nitrogen tetroxide and aerozine 50; red-fuming nitric acid and hydrazine; red-fuming nitric acid and monomethyl hydrazine; red-fuming nitric acid and unsymmetrical dimethyl hydrazine; red-fuming nitric acid and aerozine 50; hydrogen peroxide and hydrazine.

5. A blade assembly according to claim 1 wherein the, or each, passage is angled across the aerofoil member such that the, or each, passage extends transverse to the direction of a line of failure across the aerofoil member, whereby the line of failure cuts through at least one passage, or one pair of passages.

6. A blade assembly according to claim 1 wherein the or each passage extends diagonally across the aerofoil member.

7. A blade assembly according to claim 1 wherein the a region of weakness on the leading edge of the aerofoil member, whereby failure of the aerofoil member occurs at said region of weakness.

8. A blade assembly according to claim 7 wherein the region of weakness is provided in an area of the aerofoil member such that the center of gravity of the aerofoil member causes the aforesaid rearward displacement of the first portion on failure of the aerofoil member at said region of weakness.

9. A blade assembly according to claim 7 wherein the region of weakness is provided at a radially inner region of the aerofoil member.

10. A blade assembly according to claim 7 wherein the region of weakness is provided adjacent the mounting support.

* * * * *